US009051145B2

(12) United States Patent
Yokoyama et al.

(10) Patent No.: US 9,051,145 B2
(45) Date of Patent: Jun. 9, 2015

(54) SLIDE RAIL ASSEMBLY, SHEET FEEDER, AND IMAGE FORMING APPARATUS

(71) Applicants: Toshiki Yokoyama, Kanagawa (JP); Yasutomo Ide, Kanagawa (JP); Yasuhiro Kuba, Kanagawa (JP); Tsuyoshi Hashiyada, Kanagawa (JP); Kouhei Okamoto, Kanagawa (JP)

(72) Inventors: Toshiki Yokoyama, Kanagawa (JP); Yasutomo Ide, Kanagawa (JP); Yasuhiro Kuba, Kanagawa (JP); Tsuyoshi Hashiyada, Kanagawa (JP); Kouhei Okamoto, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 210 days.

(21) Appl. No.: 13/910,218

(22) Filed: Jun. 5, 2013

(65) Prior Publication Data

US 2013/0334949 A1 Dec. 19, 2013

(30) Foreign Application Priority Data

Jun. 19, 2012 (JP) ..... 2012-137448

(51) Int. Cl.

| | |
|---|---|
| ***B65H 1/22*** | (2006.01) |
| ***B65H 1/26*** | (2006.01) |
| ***A47B 88/04*** | (2006.01) |
| ***B65H 1/00*** | (2006.01) |
| ***A47B 88/14*** | (2006.01) |
| ***A47B 88/10*** | (2006.01) |

(52) U.S. Cl.

CPC ..... *B65H 1/266* (2013.01); *A47B 88/0466* (2013.01); *B65H 1/00* (2013.01); *A47B 88/14* (2013.01); *B65H 2402/32* (2013.01); *B65H 2402/46* (2013.01); *B65H 2405/114* (2013.01); *A47B 88/10* (2013.01); *A47B 2210/0043* (2013.01); *A47B 2210/0059* (2013.01)

(58) Field of Classification Search

CPC ..... B65H 1/00; B65H 1/04; B65H 2402/30; B65H 2402/32; B65H 2402/40; B65H 2405/10; B65H 2405/11; B65H 2405/30; B65H 2405/31; B65H 2405/32; B65H 1/26; B65H 1/266; B65H 2402/46; B65H 2405/114; B41J 13/103; A47B 2210/0043; A47B 2210/0059; A47B 88/10; A47B 88/14; A47B 88/0466

See application file for complete search history.

(56) References Cited

U.S. PATENT DOCUMENTS

| | | | | |
|---|---|---|---|---|
| 2013/0156476 | A1* | 6/2013 | Yokoyama et al. | 399/361 |
| 2013/0334766 | A1* | 12/2013 | Okamoto et al. | 271/145 |

FOREIGN PATENT DOCUMENTS

| | | |
|---|---|---|
| JP | 61-146208 | 7/1986 |
| JP | 62-166753 | 10/1987 |
| JP | 8-070945 | 3/1996 |
| JP | 8-252131 | 10/1996 |
| JP | 2001-173305 | 6/2001 |

* cited by examiner

*Primary Examiner* — Prasad Gokhale
(74) *Attorney, Agent, or Firm* — Cooper & Dunham LLP

(57) ABSTRACT

A slide rail assembly includes an inner rail unit, a pair of first and second outer rails, first and second roller mounted to the inner rail unit, and third and fourth rollers mounted to the pair of first and second outer rails. The inner rail unit includes an inner substrate assembly, a pair of first bent portions provided to a first side of the inner substrate assembly, and a pair of second bent portions provided to a second side of the inner substrate assembly. The first outer rail includes a first outer substrate and a pair of third bent portions. The second outer rail includes a second outer substrate and a pair of fourth bent portions. The pair of first and second outer rails is disposed with the pairs of third and fourth bent portions facing inward, and slidable against the inner rail unit.

7 Claims, 12 Drawing Sheets

SLIDE RAIL ASSEMBLY, SHEET FEEDER, AND IMAGE FORMING APPARATUS

CROSS-REFERENCE TO RELATED APPLICATION

This patent application is based on and claims priority pursuant to 35 U.S.C. §119 to Japanese Patent Application No. 2012-137448, filed on Jun. 19, 2012, in the Japan Patent Office, the entire disclosure of which is hereby incorporated by reference herein.

BACKGROUND

1. Technical Field

Exemplary aspects of the present invention generally relate to a slide rail assembly for use in a cabinet or a drawer, tray, or the like slidably attachable to an image forming apparatus such as a copier, printer, and a facsimile machine; a sheet feeder including the slide rail assembly; and an image forming apparatus including the sheet feeder.

2. Related Art

As illustrated in FIG. 1, one example of a related-art slide rail assembly 101 is constructed of an outer rail 110, an inner rail 120 assembled with the outer rail 110 to be slidably accommodatable within the outer rail 110, an increased diameter roller 103 provided to a downstream end of the inner rail 120 in a direction of accommodation of the inner rail 120 within the outer rail 110 (hereinafter referred to as an accommodation end) to engage between inwardly facing upper and lower edges 111 of the outer rail 110, and a pair of reduced diameter rollers 104 (one of which is shown in FIG. 1) provided to a downstream end of the outer rail 110 in a direction of withdrawal of the inner rail 120 from the outer rail 110 (hereinafter referred to as withdrawal end) to sandwich inwardly facing upper and lower edges 121 of the inner rail 120. A pin shaft 122 is inserted into the increased diameter roller 103 and a pin hole 120*a* formed in the inner rail 120 so that the increased diameter roller 103 is mounted to the inner rail 120. Similarly, a pin shaft 112 is inserted into each reduced diameter roller 104 and each pin hole 110*a* formed in the outer rail 110 so that the pair of reduced diameter rollers 104 is mounted to the outer rail 110, respectively.

FIGS. 2A and 2B are schematic views of the related-art slide rail assembly 101, differing in a total length thereof, respectively. Specifically, the total length of the slide rail assembly 101 illustrated in FIG. 2B is longer than the total length of the slide rail assembly 101 illustrated in FIG. 2A. It is to be noted that, for ease of illustration, only one of the reduced diameter rollers 104 is shown in FIGS. 2A and 2B.

As described previously, the related-art slide rail assembly 101 is constructed of two separate rails, that is, the outer rail 110 and the inner rail 120. The inner rail 120 is slidable against the outer rail 110 by a distance identical to total length L1 or L2 of the outer rail 110 illustrated in FIG. 2A or 2B. In other words, the longer the slidable distance of the inner rail 120 against the outer rail 110, the longer the total length L1 or L2 of the outer rail 110, which corresponds to the total length of the slide rail assembly 101 in a state in which the inner rail 120 is accommodated within the outer rail 110. In addition, the longer the slidable distance of the inner rail 120 against the outer rail 110, the longer the distance t1 or t2 between the reduced diameter roller 104 of the outer rail 110, which is a fulcrum of slide movement of the slide rail assembly 101, and an upstream end of the inner rail 120 in the direction of withdrawal of the inner rail 120, that is, the accommodation end of the inner rail 120 to which the increased diameter roller 103 is mounted. Consequently, when the inner rail 120 is withdrawn from the outer rail 110, a load applied to the upstream end of the inner rail 120 increases, thereby possibly breaking the inner rail 120. Thus, insufficient load-bearing capacity of the inner rail 120 limits any increase in the slidable distance of the inner rail 120 against the outer rail 110.

To solve the above-described problem of limited load-bearing capacity, another example of a related-art slide rail assembly 201 is constructed of three separate, telescoping rails as illustrated in FIG. 3. The slide rail assembly 201 includes an outer rail 210, an intermediate rail 220 slidably insertable into the outer rail 210, and an inner rail 230 slidably insertable into the intermediate rail 220. The inner rail 230 carries a drawer, not shown for ease of illustration.

Because the telescopic slide rail assembly 201 is constructed of the three separate rails, a length of each rail can be reduced compared to the slide rail assembly 101, which is constructed of the two separate rails, thereby downsizing the total length of the slide rail assembly 201 in an accommodation state in which both the intermediate rail 220 and the inner rail 230 are accommodated within the outer rail 210. In addition, the shorter length of each rail improves load durability.

However, because the intermediate rail 220, into which the inner rail 230 is inserted, is further inserted into the outer rail 210 in the accommodation state, a height of the slide rail assembly 201 is increased compared to the slide rail assembly 101 constructed of the two rails.

SUMMARY

In view of the foregoing, illustrative embodiments of the present invention provide a compact slide rail assembly with improved strength, a novel sheet feeder including the slide rail assembly, and a novel image forming apparatus including the sheet feeder.

In one illustrative embodiment, a slide rail assembly includes an inner rail unit, a pair of first and second outer rails to sandwich the inner rail unit, and first, second, third, and fourth rollers. The inner rail unit includes a rectangular inner substrate assembly, a pair of first bent portions provided to a first side of the inner substrate assembly in thickness directions, one end of which is continuous with both edges of the inner substrate assembly in width directions, and opposite ends of which are bent toward each other, and a pair of second bent portions provided to a second side of the inner substrate assembly opposite the first side in the thickness directions, one end of which is continuous with both edges of the inner substrate assembly in the width directions, and opposite ends of which are bent toward each other. The first outer rail includes a rectangular first outer substrate, and a pair of third bent portions, one end of which is continuous with both edges of the first outer substrate in width directions, and opposite ends of which are bent toward each other. The second outer rail includes a rectangular second outer substrate, and a pair of fourth bent portions, one end of which is continuous with both edges of the second outer substrate in the width directions, and opposite ends of which are bent toward each other. The pair of first and second outer rails is disposed with the pairs of third and fourth bent portions facing inward, and slidable against the inner rail unit in both a withdrawal direction and an accommodation direction along longitudinal directions of the inner substrate assembly. The first roller is mounted to a leading end of the inner rail unit in the withdrawal direction to slidably contact inner surfaces of the pair of third bent portions. The second roller is mounted to a leading end of the inner rail unit in the accommodation direction to slidably contact inner surfaces of the pair of fourth bent portions. The third roller is mounted to a leading end of the first outer rail in the accommodation direction to slidably contact inner surfaces of the pair of first bent portions. The fourth roller is mounted to a leading end of the second outer rail in the withdrawal direction to slidably contact inner surfaces of the pair of second bent portions.

In another illustrative embodiment, a sheet feeder includes a sheet tray withdrawable from the sheet feeder to accommodate sheets, and the slide rail assembly described above mounted to both lateral sides of the sheet tray to guide the sheet tray in a withdrawal direction.

In yet another illustrative embodiment, an image forming apparatus includes the sheet feeder described above and the slide rail assembly described above.

Additional features and advantages of the present disclosure will become more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1:
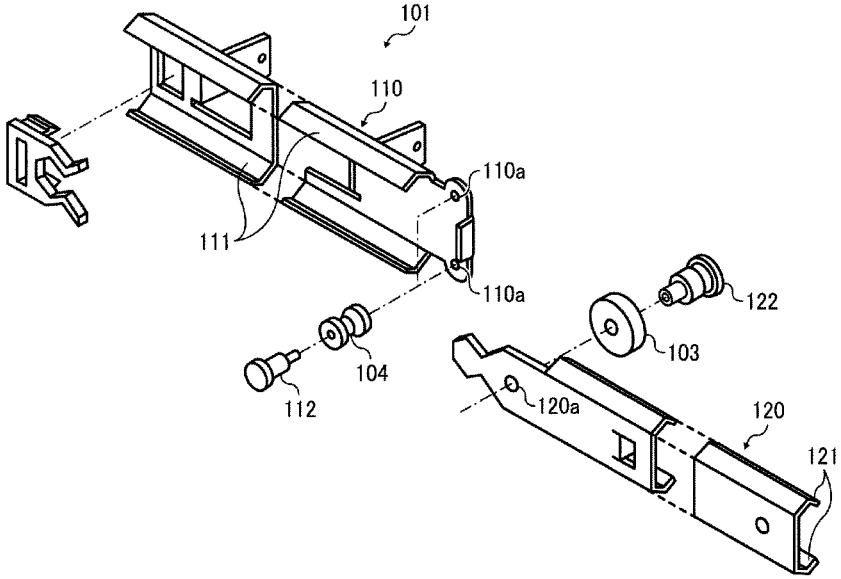
FIG. 1 RELATED ART
FIG. 1 is an exploded perspective view illustrating an example of a configuration of a related-art slide rail assembly.
Figure 2A:
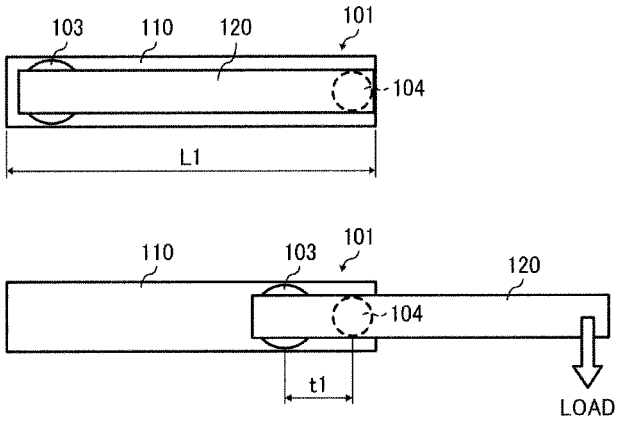
FIG. 2A RELATED ART
FIGS. 2A and 2B are schematic views of the related-art slide rail assembly, differing in a total length thereof, respectively.
Figure 2B:
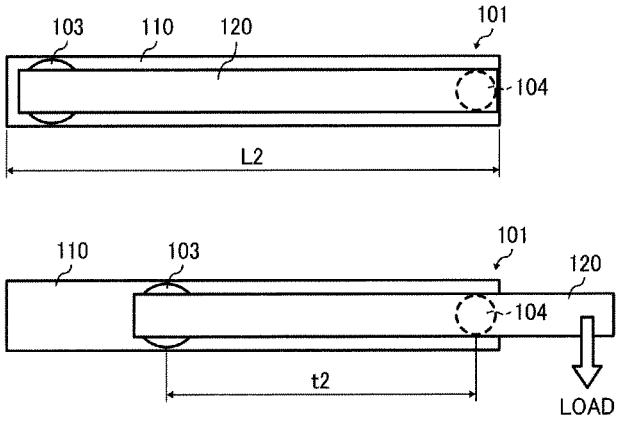
FIG. 2B RELATED ART
Figure 3:
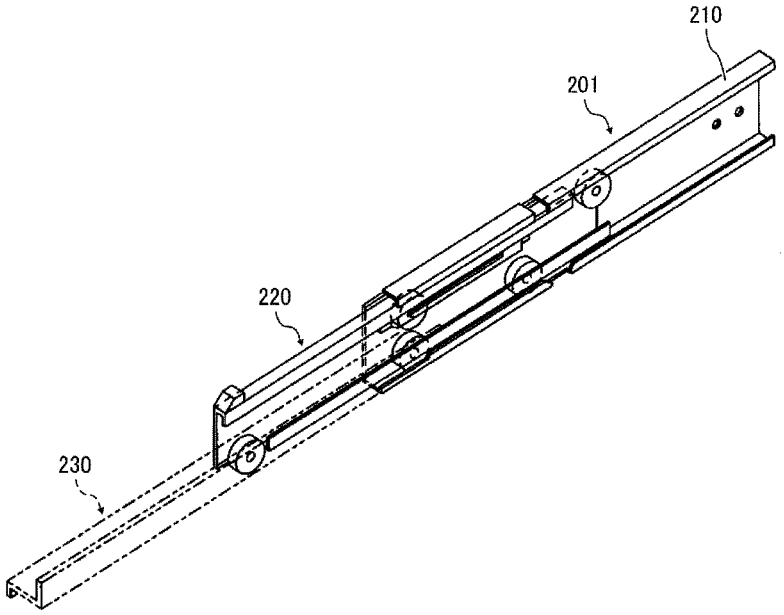
FIG. 3 RELATED ART
FIG. 3 is a perspective view illustrating another example of a configuration of a related-art slide rail assembly.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have substantially the same function, operate in a similar manner, and achieve a similar result.

Illustrative embodiments of the present invention are now described below with reference to the accompanying drawings. In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

A description is now given of an example of a configuration of a slide rail assembly 1 for use in an image forming apparatus 100 according to a first illustrative embodiment.

Figure 4:
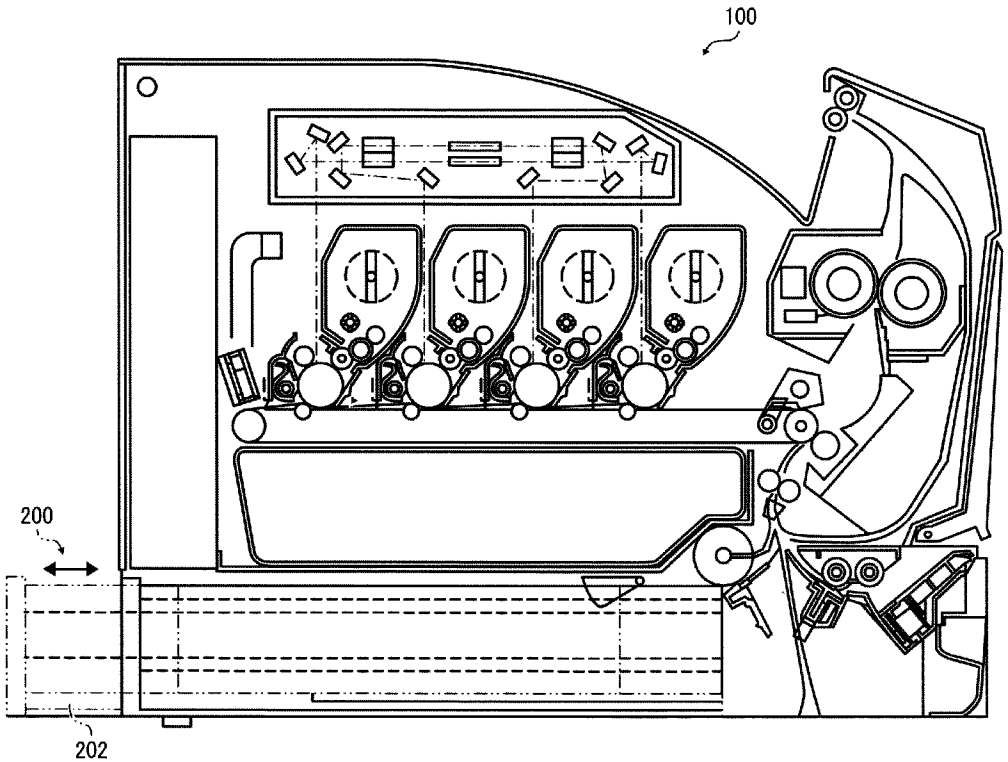
FIG. 4 is a vertical cross-sectional view illustrating an example of a configuration of an image forming apparatus according to illustrative embodiments.
Figure 5:
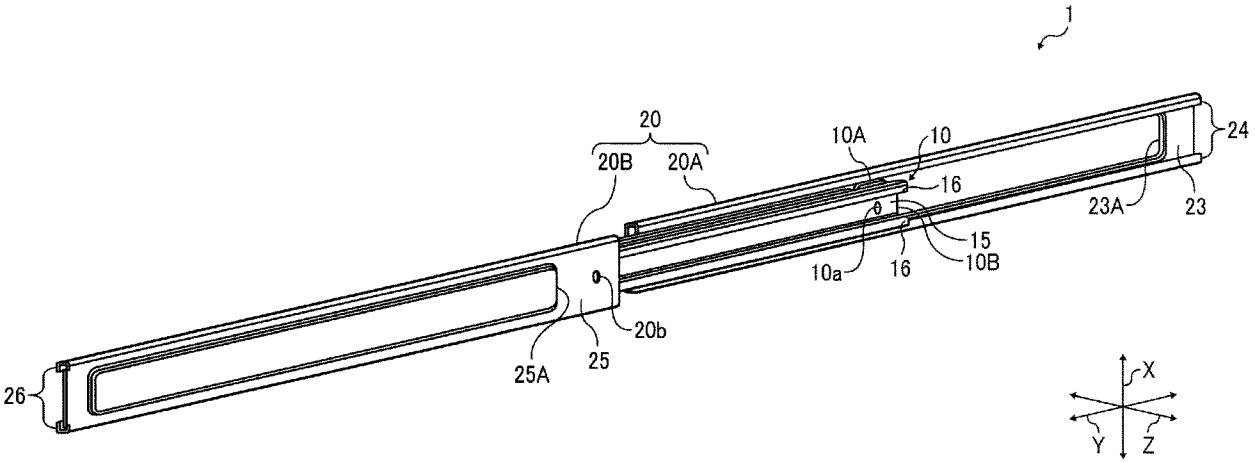
FIG. 5 is a perspective view illustrating an example of a configuration of a slide rail assembly according to a first illustrative embodiment.
Figure 6:
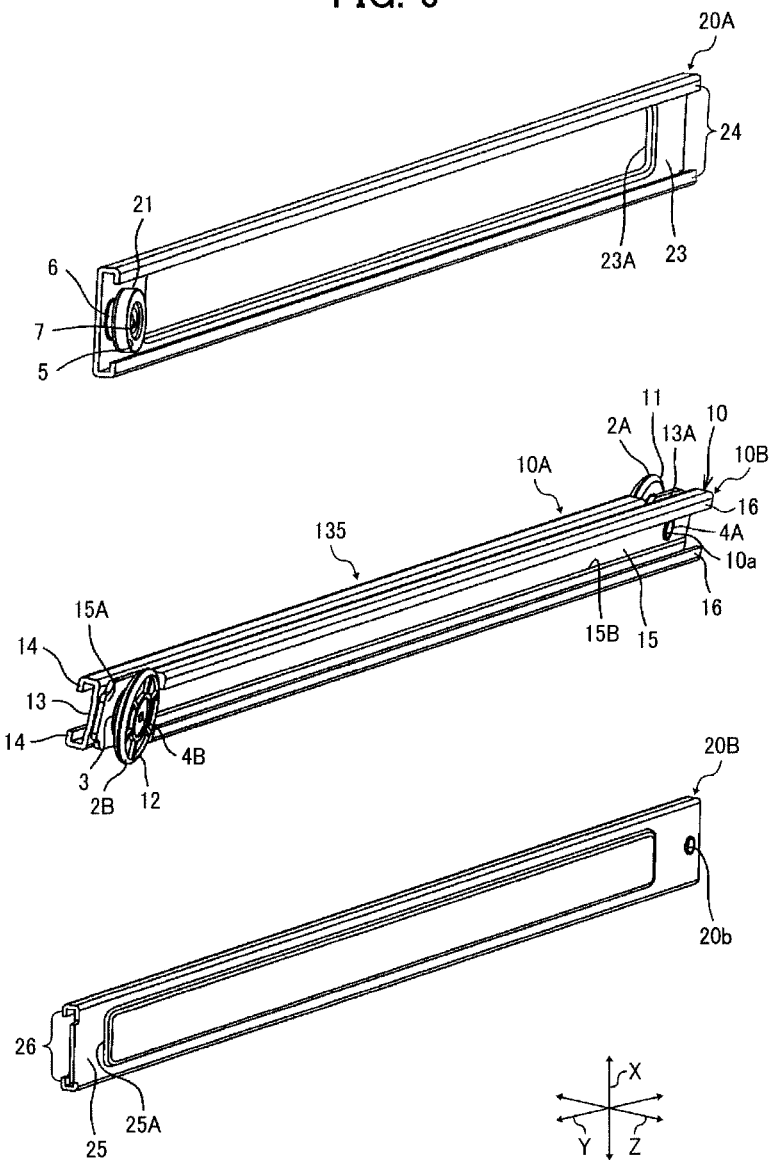
FIG. 6 is an exploded perspective view of the slide rail assembly illustrated in FIG. 5.
Figure 7:
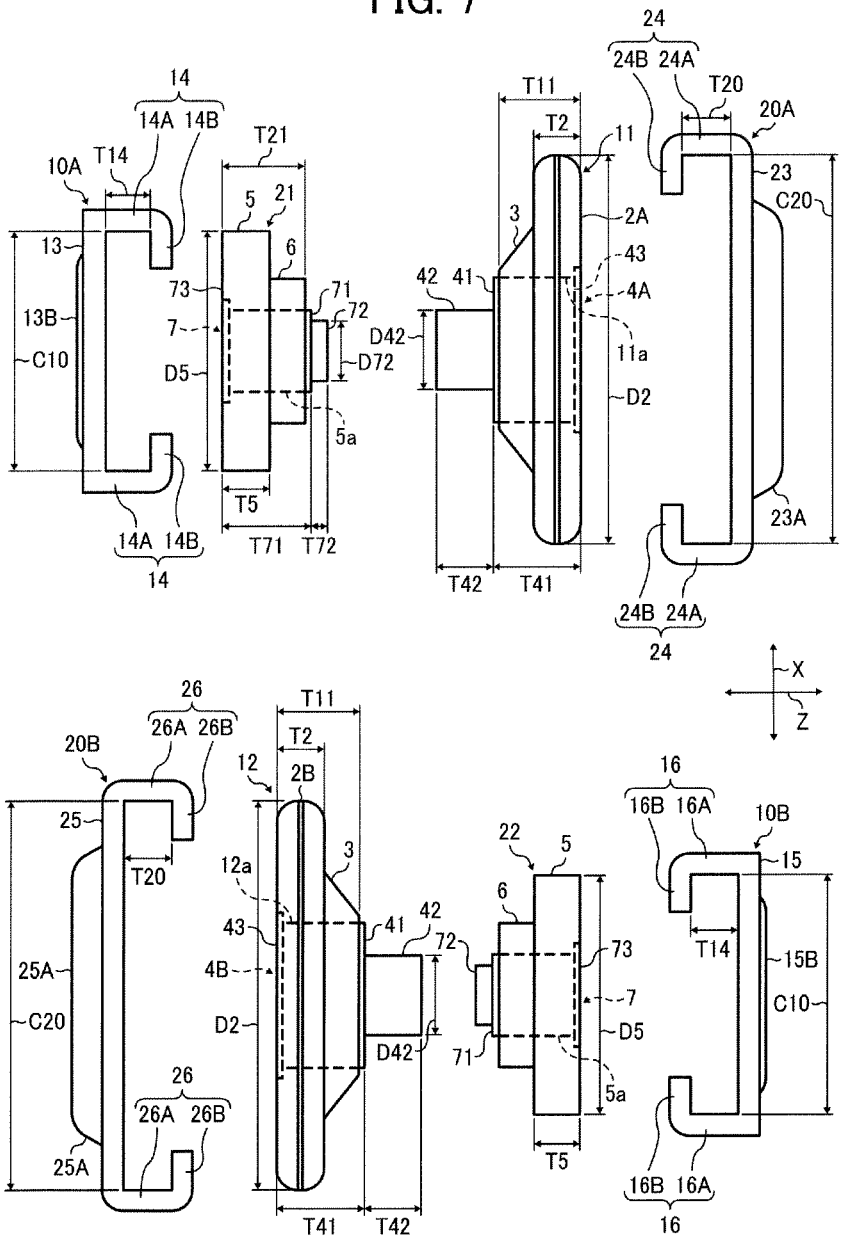
FIG. 7 is an exploded vertical cross-sectional view of the slide rail assembly.

FIG. 4 is a vertical cross-sectional view illustrating an example of a configuration of the image forming apparatus 100. FIG. 5 is a perspective view illustrating an example of a configuration of the slide rail assembly 1 according to the first illustrative embodiment. FIG. 6 is an exploded perspective view of the slide rail assembly 1. FIG. 7 is an exploded vertical cross-sectional view of the slide rail assembly 1.

The slide rail assembly 1 is employed in the image forming apparatus 100 including a body and a sheet feeder 200 withdrawably accommodatable in the body. The sheet feeder 200 includes a sheet tray 202 that accommodates a stack of recording media such as sheets of paper and a pair of the slide rail assemblies 1 mounted to both lateral sides of the sheet tray 202, respectively. The pair of the slide rail assemblies 1 guides the sheet tray 202 in a withdrawal direction in which the sheet tray 202 is withdrawn from the body of the image forming apparatus 100.

The slide rail assembly 1 is constructed of an inner rail unit 10, first and second rollers 11 and 12, both of which are rotatably mounted to the inner rail unit 10, an outer rail unit 20 including a pair of first and second outer rails 20A and 20B that sandwich the inner rail unit 10 on opposite sides thereof, a third roller 21 rotatably mounted to the first outer rail 20A, and a fourth roller 22 (shown in FIG. 7) rotatably mounted to the second outer rail 20B. Both the first and second outer rails 20A and 20B are slidable against the inner rail unit 10 along longitudinal directions in both the withdrawal direction, in which the sheet tray 202 is withdrawn from the body of the image forming apparatus 100, and an accommodation direction, in which the sheet tray 202 is accommodated within the body of the image forming apparatus 100. Relative positions of the inner rail unit 10 and each of the first and second outer rails 20A and 20B are variable by sliding the first or second outer rail 20A or 20B against the inner rail unit 10. In other words, the first and second outer rails 20A and 20B are individually and independently slidable against the inner rail unit 10 without moving in conjunction with each other.

The inner rail unit 10 is constructed of two separate rails, that is, a first inner rail 10A and a second inner rail 10B, both of which are fixed together. It is to be noted that the first and second inner rails 10A and 10B have the same basic shape and structure. Two sheets of metal laminated one atop the other are blanked and bent to form the first or second inner rail 10A or 10B. Thus, the same mold may be used for both the first and second inner rails 10A and 10B.

The inner rail unit 10 has a first through-hole, that is, a first mounting hole 10*a*, to which the first roller 11 is mounted, and a second through-hole, that is, a second mounting hole 10*b* (shown in FIG. 8), to which the second roller 12 is mounted. The first mounting hole 10*a* is provided to a downstream end of the inner rail unit 10 in the withdrawal direction of the sheet tray 202 (hereinafter referred to as a withdrawal end), and the second mounting hole 10*b* is provided to a downstream end of the inner rail unit 10 in the accommodation direction of the sheet tray 202 (hereinafter referred to as an accommodation end), which is opposite the withdrawal end. Both the first and second mounting holes 10*a* and 10*b* penetrate into a first inner substrate 13 provided to the first inner rail 10A and a second inner substrate 15 provided to the second inner rail 10B.

The first inner rail 10A is constructed of the rectangular first inner substrate 13 and a pair of first bent portions 14 that is continuous with longitudinal edges of the first substrate 13, respectively, with opposed ends thereof that are bent inward toward each other and generally parallel to the first substrate 13.

It is to be noted that double-headed arrow Y in the drawings indicates directions in which the inner rail unit 10 and the pair of first and second outer rails 20A and 20B are slidable (hereinafter referred to as slide directions), which correspond to the longitudinal directions of the first and second substrates 13 and 15 and third and fourth substrates 23 and 25 described later. Double-headed arrow X indicates directions of a height of each of the inner rail unit 10 and the pair of first and second outer rails 20A and 20B, which correspond to the width directions of each of the first, second, third, and fourth substrates 13, 15, 23, and 25. Double-headed arrow Z indicates directions of a thickness of each of the inner rail unit 10, the pair of first and second outer rails 20A and 20B, the first, second, third, and fourth substrates 13, 15, 23, and 25.

A length of the first substrate 13 is longer than a length of each first bent portion 14 in the longitudinal directions. Specifically, as illustrated in FIG. 6, in place of the pair of first bent portions 14, a first extending portion 13A is provided to the withdrawal end of the first substrate 13. The first extending portion 13A is a part of the first substrate 13, and the first mounting hole 10*a* is formed at the center thereof in the height directions. In addition, as described previously, the second mounting hole 10*b* is formed at the center of the accommodation end of the first substrate 13 in the height directions. To reinforce the first inner rail 10A, a first bulge 13B that slightly bulges outward in the thickness directions of the first substrate 13 is provided at the center of the first substrate 13 across the longitudinal directions, excluding a part in which the first extending portion 13A is provided. Specifically, excluding the part in which the first extending portion 13A is provided, the first bulge 13B is provided to the first substrate 13 across the longitudinal directions at a position away from both upper and lower edges of the first substrate 13.

Each first bent portion 14 is L-shaped in cross-section and is constructed of a first standing plate 14A, which is bent in a direction perpendicular to the first substrate 13, and a first parallel plate 14B, which is bent in a direction perpendicular to the first standing plate 14A to be parallel to the first substrate 13. The pair of first bent portions 14 is formed on one side of the first substrate 13 in the thickness directions, respectively.

Similarly, the second inner rail 10B is constructed of the rectangular second inner substrate 15 and a pair of second bent portions 16 that is continuous with longitudinal edges of the second substrate 15, respectively, with opposed ends thereof that are bent inward toward each other and generally parallel to the second substrate 15. The first and second inner substrates 13 and 15 together form an inner substrate assembly 135 of the inner rail unit 10.

Figure 8:
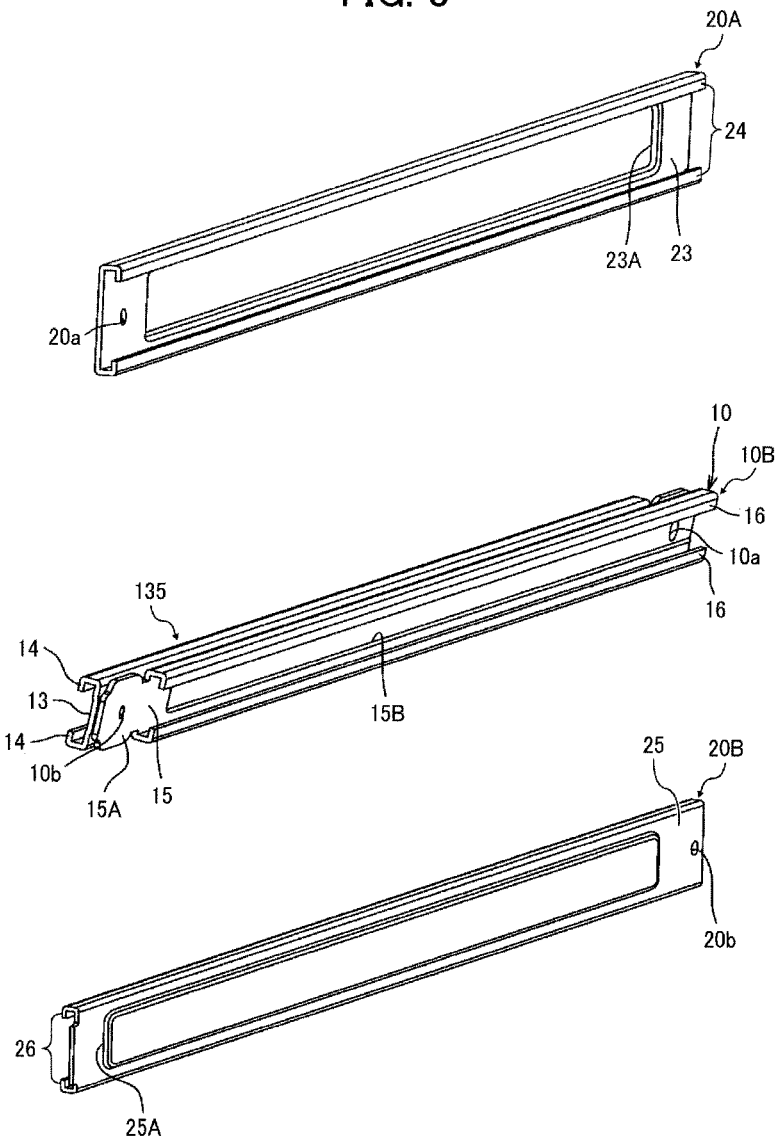
FIG. 8 is an exploded perspective view of the slide rail assembly.

A length of the second substrate 15 is longer than a length of each second bent portion 16 in the longitudinal directions. Specifically, as illustrated in FIGS. 6 and 8, in place of the pair of second bent portions 16, a second extending portion 15A is provided to the accommodation end of the second substrate 15. The second extending portion 15A is a part of the second substrate 15, and the second mounting hole 10*b* is formed at the center thereof in the height directions. In addition, as described previously, the first mounting hole 10*a* is provided at the center of the withdrawal end of the second substrate 15 in the height directions. To reinforce the second inner rail 10B, a second bulge 15B that slightly bulges outward in the thickness directions of the second substrate 15 is provided at the center of the second substrate 15 across the longitudinal directions, excluding a part in which the second extending portion 15A is provided. Specifically, excluding the part in which the second extending portion 15A is provided, the second bulge 15B is provided to the second substrate 15 across the longitudinal directions at a position away from both upper and lower edges of the second substrate 15.

Each second bent portion 16 is L-shaped in cross-section and is constructed of a second standing plate 16A, which is bent in a direction perpendicular to the second substrate 15, and a second parallel plate 16B, which is bent in a direction perpendicular to the second standing plate 16A to be parallel to the second substrate 15. The pair of second bent portions 16 is formed on the other side of the second substrate 15, respectively, in the thickness directions opposite the side in which the pair of first bent portions 14 is formed in the first substrate 13 of the first inner rail 10A.

The first and second substrates 13 and 15 of the first and second inner rails 10A and 10B are fixed together back-to-back by welding, bonding, or any well-known method to form the inner rail unit 10 with the pairs of first and second bent portions 14 and 16 protruding outward in opposite directions, respectively. As a result, the first and second mounting holes 10*a* and 10*b* are formed in the inner rail unit 10 at the withdrawal and accommodation ends, respectively.

As shown in FIG. 7, the first roller 11 is constructed of a disk-shaped first main body 2A, a pedestal 3 tapered toward a leading end and continuous coaxially with the main body 2A, a first hole 11*a* penetrating the axial center of both the main body 2A and the pedestal 3, and a shaft 4A inserted into the first hole 11*a*. A diameter of the main body 2A increases approaching the center thereof in the thickness directions. A maximum diameter D2 of the main body 2A is slightly smaller than a height C20 between third standing plates 24A of a pair of third bent portions 24 provided to the first outer rail 20A, which are described in detail later. A thickness T2 of the main body 2A is slightly smaller than a width T20 between the third substrate 23 of the first outer rail 20A and third parallel plates 24B of the pair of third bent portions 24, which are also described in detail later. Thus, the first roller 11 having the main body 2A slidably engages inner surfaces of the pair of third bent portions 24 of the first outer rail 20A.

The shaft 4A is constructed of a main body 41, a reduced diameter portion 42 continuous with one end of the main body 41, and an increased diameter portion 43 continuous with the opposite end of the main body 41. A diameter D42 of the reduced diameter portion 42 is smaller than a diameter of the main body 41, and a diameter of the increased diameter portion 43 is larger than the diameter of the main body 41. The main body 41, the reduced diameter portion 42, and the increased diameter portion 43 are coaxial. An axial length T41 of the shaft 4A, that is, a total thickness of the main body 41 and the increased diameter portion 43, is slightly longer than a total thickness T11 of the main body 2A and the pedestal 3 of the first roller 11. When the first roller 11 is mounted to the first inner rail 10A, an end face of the main body 41 of the shaft 4A contacts the first substrate 13 of the first inner rail 10A. The diameter D42 of the reduced diameter portion 42 is slightly smaller than a diameter of the first mounting hole 10*a*, and an axial length T42 of the reduced diameter portion 42 is slightly longer than a total thickness of the first and second substrates 13 and 15 laminated together.

The first roller 11 on the pedestal 3 side is positioned closer to one face of the first substrate 13 in the thickness directions so that the first hole 11*a* formed in the first roller 11 communicates with the first mounting hole 10*a*. The shaft 4A of the first roller 11 is inserted into the first hole 11*a* and the first mounting hole 10*a* communicating with each other, and the leading end of the shaft 4A is fixed to the first substrate 13 on the opposite face of the first substrate 13 using a well-known method. Thus, the first roller 11 is rotatably mounted to the first inner rail 10A. In a manner similar to the first roller 11, the second roller 12 is rotatably mounted to the second inner rail 10B as described in detail below.

It is to be noted that, the first and second rollers 11 and 12 have the same basic shape and structure, and the same reference numerals are partially used for those components of the second roller 12 identical to the components of the first roller 11. The second roller 12 is constructed of a disk-shaped second main body 2B, a pedestal 3 that is tapered toward a leading end and continuous coaxially with the main body 2B, a second hole 12*a* penetrating in the center of both the main body 2B and the pedestal 3, and a shaft 4B inserted into the second hole 12*a*. A diameter of the main body 2B increases approaching the center thereof in the thickness directions. A maximum diameter D2 of the main body 2B is slightly smaller than a height C20 between fourth standing plates 26A of a pair of fourth bent portions 26 provided to the second outer rail 20B, which are described in detail later, and a thickness T2 of the main body 2B is slightly smaller than a width T20 between the fourth substrate 25 of the second outer rail 20B and fourth parallel plates 26B of the pair of fourth bent portions 26, which are also described in detail later. Thus, the second roller 12 having the main body 2B slidably engages inner surfaces of the pair of fourth bent portions 26 of the second outer rail 20B.

Similarly, the first and second shaft 4A and 4B of the first and second rollers 11 and 12 have the same basic shape and structure. The shaft 4B is constructed of a main body 41, a reduced diameter portion 42 continuous with one end of the main body 41, and an increased diameter portion 43 continuous with the opposite end of the main body 41. A diameter D42 of the reduced diameter portion 42 is smaller than a diameter of the main body 41, and a diameter of the increased diameter portion 43 is larger than the diameter of the main body 41. The main body 41, the reduced diameter portion 42, and the increased diameter portion 43 are coaxial. An axial length T41 of the shaft 4B, that is, a total thickness of the main body 41 and the increased diameter portion 43, is slightly longer than a total thickness T11 of the main body 2B and the pedestal 3 of the second roller 12. When the second roller 12 is mounted to the second inner rail 10B, an end face of the main body 41 of the shaft 4B contacts the second substrate 15 of the second inner rail 10B. The diameter D42 of the reduced diameter portion 42 is slightly smaller than a diameter of the second mounting hole 10*b*, and an axial length T42 of the reduced diameter portion 42 is slightly longer than a total thickness of the first and second substrates 13 and 15 laminated together.

As described previously, the outer rail unit 20 is constructed of two separate rails, that is, the first outer rail 20A and the second outer rail 20B. It is to be noted that the first and second outer rails 20A and 20B have the same basic shape and structure. Two sheets of metal laminated one atop the other are blanked and bent to form the first or second outer rails 20A or 20B. Thus, the same mold may be used for both the first and second outer rails 20A and 20B.

The first outer rail 20A is constructed of the rectangular third outer substrate 23 and the pair of third bent portions 24. One end of the third bent portions 24 is continuous with longitudinal edges of the third substrate 23, and opposite ends thereof are bent inward toward each other. A length of the third substrate 23 is longer than the length of the first substrate 13 in the longitudinal directions. The pair of third bent portions 24 is provided to the third substrate 23 across the longitudinal directions.

As illustrated in FIG. 8, a third mounting hole 20*a*, to which the third roller 21 is mounted, is provided to a downstream end of the third substrate 23 in the accommodation direction of the sheet tray 202 (hereinafter referred to as an accommodation end). Specifically, the third mounting hole 20*a* is formed at the center of the accommodation end of the third substrate 23 in the height directions and penetrates the third substrate 23. To reinforce the first outer rail 20A, a third bulge 23A that bulges outward in the thickness directions of the third substrate 23 is provided at the center of the third substrate 23 across the longitudinal directions, excluding a part in which the third mounting hole 20*a* is formed. Specifically, excluding the part in which the third mounting hole 20*a* is formed, the third bulge 23A is provided to the third substrate 23 across the longitudinal directions at a position away from both upper and lower edges and both ends of the third substrate 23.

Each third bent portion 24 is L-shaped in cross-section and is constructed of the third standing plate 24A, which is bent in a direction perpendicular to the third substrate 23, and the third parallel plate 24B, which is bent in a direction perpendicular to the third standing plate 24A to be parallel to the third substrate 23. The pair of third bent portions 24 is formed on the other side of the third substrate 23 in the thickness directions, respectively.

The second outer rail 20B is constructed of the rectangular fourth outer substrate 25 and the pair of fourth bent portions 26. One end of the fourth bent portions 26 is continuous with longitudinal edges of the fourth substrate 25, and opposite ends thereof are bent inward toward each other. A length of the fourth substrate 25 is longer than the length of the second substrate 15 in the longitudinal directions. The pair of fourth bent portions 26 is provided to the fourth substrate 25 across the longitudinal directions.

As illustrated in FIGS. 6 and 8, a fourth mounting hole 20*b*, to which the fourth roller 22 is mounted, is provided to a downstream end of the fourth substrate 4 in the withdrawal direction of the sheet tray 202 (hereinafter referred to as a withdrawal end). Specifically, the fourth mounting hole 20*b* is formed at the center of the withdrawal end of the fourth substrate 25 in the height directions and penetrates the fourth substrate 25. To reinforce the second outer rail 20B, a fourth bulge 25A that bulges outward in the thickness directions of the fourth substrate 25 is provided at the center of the fourth substrate 25 across the longitudinal directions, excluding a part in which the fourth mounting hole 20*b* is formed. Specifically, excluding the part in which the fourth mounting hole 20*b* is formed, the fourth bulge 25A is provided to the fourth substrate 25 across the longitudinal directions at a position away from both upper and lower edges and both ends of the fourth substrate 25.

Each fourth bent portion 26 is L-shaped in cross-section and is constructed of the fourth standing plate 26A, which is bent in a direction perpendicular to the fourth substrate 25, and the fourth parallel plate 26B, which is bent in a direction perpendicular to the fourth standing plate 26A to be parallel to the fourth substrate 25. The pair of fourth bent portions 26 is formed on one side of the fourth substrate 25, respectively, in the thickness directions opposite the other side in which the pair of third bent portions 24 is formed in the third substrate 23 of the first outer rail 20A.

The third roller 21 is constructed of a disk-shaped third main body 5, a pedestal 6 that is tapered toward a leading end and continuous coaxially with the main body 5, a hole 5*a* penetrating in the center of both the main body 5 and the pedestal 6, and a shaft 7 inserted into the hole 5*a*. The main body 5 of the third roller 21 is cylindrically shaped and has the same outer diameter across the thickness directions. A maximum diameter D5 of the main body 5 is slightly smaller than a height C10 between the first standing plates 14A of the pair of first bent portions 14 provided to the first inner rail 10A, and a thickness T5 of the main body 5 is slightly shorter than a width T14 between the first substrate 13 of the first inner rail 10A and the first parallel plates 14B of the pair of first bent portions 14. Thus, the third roller 21 having the main body 5 slidably engages inner surfaces of the pair of first bent portions 14 of the first inner rail 10A.

The shaft 7 is constructed of a main body 71, a reduced diameter portion 72 continuous with one end of the main body 71, and an increased diameter portion 73 continuous with the opposite end of the main body 71. A diameter D72 of the reduced diameter portion 72 is smaller than a diameter of the main body 71, and a diameter of the increased diameter portion 73 is larger than the diameter of the main body 71. The main body 71, the reduced diameter portion 72, and the increased diameter portion 73 are coaxial. An axial length T71 of the shaft 7, that is, a total thickness of the main body 71 and the increased diameter portion 73, is slightly longer than a total thickness T21 of the main body 5 and the pedestal 6 of the third roller 21. When the third roller 21 is mounted to the first outer rail 20A, an end face of the main body 71 of the shaft 7 contacts the third substrate 23 of the first outer rail 20A. The diameter D72 of the reduced diameter portion 72 is slightly smaller than a diameter of the third mounting hole 20*a*, and an axial length T72 of the reduced diameter portion 72 is slightly longer than the thickness of the third substrate 23.

Figure 9:
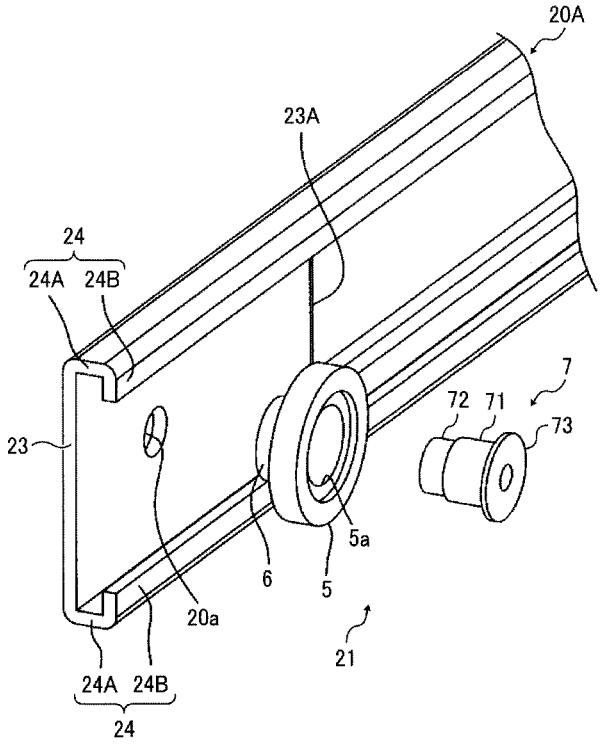
FIG. 9 is a partial exploded perspective view illustrating mounting of a third roller to a first outer rail.

FIG. 9 is a partial exploded perspective view illustrating mounting of the third roller 21 to the first outer rail 20A. To mount the third roller 21 to the first outer rail 20A, first the third roller 21 on the pedestal 6 side is positioned closer to one face of the third substrate 23 in the thickness directions so that the hole 5*a* formed in the third roller 21 communicates with the third mounting hole 20*a*. The shaft 7 of the third roller 21 is inserted into the hole 5*a* and the third mounting hole 20*a* communicating with each other, and the leading end of the shaft 7 is fixed to the third substrate 23 on the opposite face of the third substrate 23 using a well-known method. Thus, the third roller 21 is rotatably mounted to the first outer rail 20A. In a manner similar to the third roller 21, the fourth roller 22 is rotatably mounted to the second outer rail 20B as described in detail below.

It is to be noted that, the third and fourth rollers 21 and 22 have the same basic shape and structure, and the same reference numerals are partially used for those components of the fourth roller 22 identical to the components of the third roller 21. The fourth roller 22 is constructed of a disk-shaped fourth main body 5, a pedestal 6 that is tapered toward a leading end and continuous coaxially with the main body 5, a hole 5*a* penetrating in the center of both the main body 5 and the pedestal 6, and a shaft 7 inserted into the hole 5*a*. The main body 5 of the fourth roller 22 is cylindrically shaped and has the same outer diameter across the thickness directions. A maximum diameter D5 of the main body 5 is slightly smaller than a height C10 between the second standing plates 16A of the pair of second bent portions 16 provided to the second inner rail 10B, and a thickness T5 of the main body 5 is slightly shorter than a width T14 between the second substrate 15 of the second inner rail 10B and the second parallel plates 16B of the pair of second bent portions 16. Thus, the fourth roller 22 having the main body 5 slidably engages inner surfaces of the pair of second bent portions 16 of the second inner rail 10B.

Figure 10:
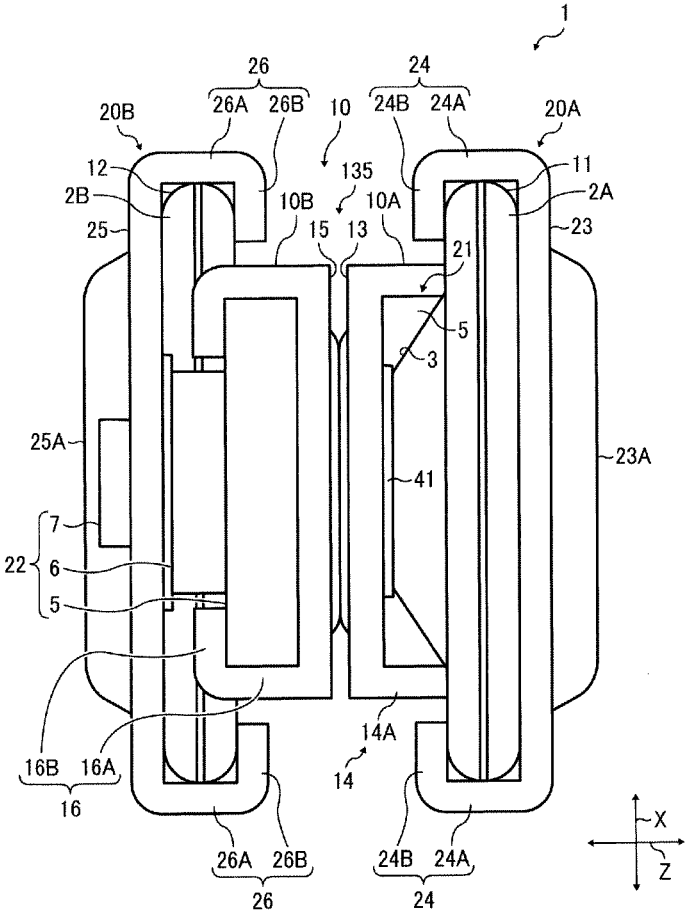
FIG. 10 is a vertical cross-sectional view of the slide rail assembly according to the first illustrative embodiment.

A description is now given of the process of assembly of the slide rail assembly 1. First, the first and second inner rails 10A and 10B are assembled into the inner rail unit 10 with the first and second rollers 11 and 12 rotatably mounted as described previously. Next, the third and fourth rollers 21 and 22 are rotatably mounted to the first and second outer rails 20A and 20B, respectively. Then, the accommodation end of the first inner rail 10A is positioned closer to the withdrawal end of the first outer rail 20A to insert the first inner rail 10A into the first outer rail 20A, so that the third roller 21 is positioned within the pair of first bent portions 14 of the first inner rail 10A and the first roller 11 within the pair of third bent portions 24 of the first outer rail 20A, respectively. Thus, the first roller 11 slidably engages the pair of third bent portions 24, and the third roller 21 slidably engages the pair of first bent portions 14. Thereafter, the withdrawal end of the second inner rail 10B is positioned closer to the accommodation end of the second outer rail 20B to insert the second inner rail 10B into the second outer rail 20B, so that the second roller 12 is positioned within the pair of fourth bent portions 26 of the second outer rail 20B and the fourth roller 22 within the pair of second bent portions 16 of the second inner rail 10B, respectively. Thus, the second roller 12 slidably engages the pair of fourth bent portions 26, and the fourth roller 22 slidably engages the pair of second bent portions 16. Accordingly, the first and second outer rails 20A and 20B are slidable against the inner rail unit 10, respectively, to construct the slide rail assembly 1 as illustrated in FIG. 10. FIG. 10 is a vertical cross-sectional view of the slide rail assembly 1. In the slide rail assembly 1, relative positions of the inner rail unit 10 and each of the first and second outer rails 20A and 20B are variable by sliding the first and second outer rails 20A and 20B against the inner rail unit 10, respectively.

A description is now given of functions and effects of the present illustrative embodiment. The inner rail unit 10 has the pair of first bent portions 14 and the pair of second bent portions 16, both of which protrude outward in the opposite directions, respectively. The pair of first and second outer rails 20A and 20B has the pair of third bent portions 24 positioned opposite the pair of first bent portions 14 of the inner rail unit 10 and the pair of fourth bent portions 26 positioned opposite the pair of second bent portions 16 of the inner rail unit 10. The pair of first bent portions 14 and the pair of third bent portions 24 slidably engage each other via the first and third rollers 11 and 21, and the pair of second bent portions 16 and the pair of fourth bent portions 26 slidably engage each other via the second and fourth rollers 12 and 22. As a result, the three separate rails, that is, the inner rail unit 10 and the first and second outer rails 20A and 20B, do not overlap one another in the vertical directions upon accommodation of the inner rail unit 10 within both the first and second outer rails 20A and 20B, thereby downsizing the slide rail assembly 1 in the vertical directions compared to the related-art slide rail assembly 201 in which the three separate rails are inserted into one another. As described above, the slide rail assembly 1 is constructed of three separate rails, that is, the inner rail unit 10 and the first and second outer rails 20A and 20B, both of which sandwich the inner rail unit 10. The four rollers 11, 12, 21, and 22 are appropriately positioned within the slide rail assembly 1 so that a load applied to the withdrawal end of the slide rail assembly 1 with the fourth roller 22 as a fulcrum is spread across the inner rail unit 10 and one of the first and second outer rails 20A and 20B, thereby improving load capacity of the slide rail assembly 1 as a whole.

The first substrate 13 and the second substrate 15 are laminated and fixed together to form the inner substrate assembly 135. The pair of first bent portions 14 is provided to one side of the inner substrate assembly 135. One end of the first bent portions 14 is continuous with the upper and lower longitudinal edges of the first substrate 13, and opposite ends of the first bent portions 14 are bent inward toward each other. The pair of second bent portions 16 is provided to the other side of the inner substrate assembly 135 opposite the one side thereof. Thus, the first and second bent portions 14 and 16 protrude outward in the opposite directions, respectively. One end of the second bent portions 16 is continuous with the upper and lower longitudinal edges of the second substrate 15, and opposite ends of the second bent portions 16 are bent inward toward each other. The inner rail unit 10 is constructed by laminating the first substrate 13 of the first inner rail 10A and the second substrate 15 of the second inner rail 10B together, thereby facilitating manufacture of the slide rail assembly 1.

The first roller 11 includes the first main body 2A having the first hole 11*a* at the center therein. The first hole 11*a* communicates with the first mounting hole 10*a* that penetrates both the first and second substrates 13 and 15 so that the shaft 4A of the first roller 11 is inserted into both the first hole 11*a* and the first mounting hole 10*a* to rotatably mount the first roller 11 to the inner rail unit 10. The second roller 12 includes the second main body 2B having the second hole 12*a* at the center therein. The second hole 12*a* communicates with the second mounting hole 10*b* that penetrates both the first and second substrates 13 and 15 so that the shaft 4B of the second roller 12 is inserted into both the second hole 12*a* and the second mounting hole 10*b* to rotatably mount the second roller 12 to the inner rail unit 10. As a result, the first and second inner rails 10A and 10B, both of which are laminated together, are securely fixed to each other.

The first, second, third, and fourth rollers 11, 12, 21, and 22 are rotatably provided to the slide rail assembly 1, respectively. Accordingly, the slide rail assembly 1, in which the inner rail unit 10 and the first and second outer rails 20A and 20B are slidable against one another, has improved slidability.

In the above-described example, the first and second substrates 13 and 15 are laminated and fixed together back-to-back by bonding, welding, or any well-known method such that the pairs of first and second bent portions 14 and 16 protrude outward in the opposite directions, respectively. As a result, the first and second inner rails 10A and 10B are fixed together to be assembled into the inner rail unit 10. Alternatively, the first and second inner rails 10A and 10B may be fixed together by inserting the shafts 4A and 4B of the first and second rollers 11 and 12 into the first and second mounting holes 10*a* and 10*b*, respectively, without bonding, welding, or the like.

Figure 11A:
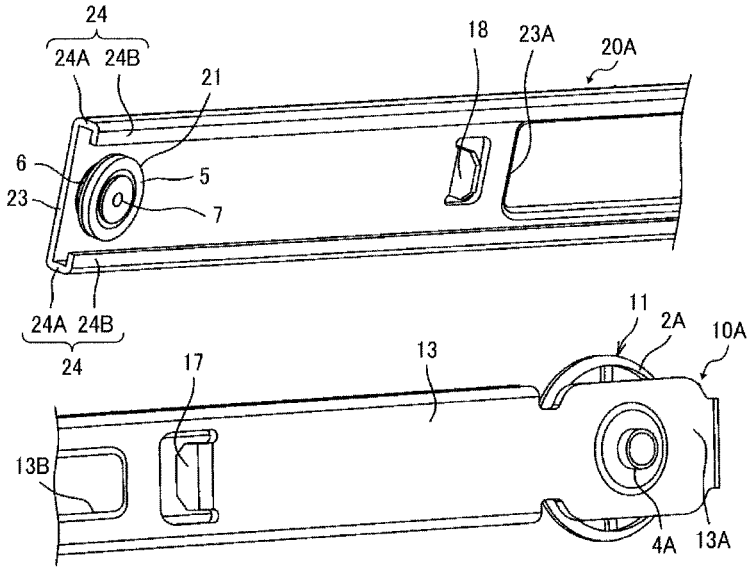
FIG. 11A is a perspective view illustrating a first inner rail and a first outer rail of a slide rail assembly according to a second illustrative embodiment.
Figure 11B:
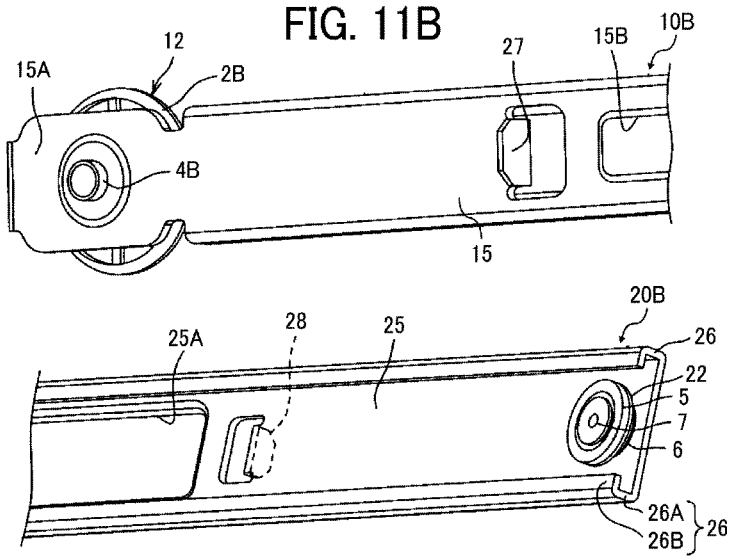
FIG. 11B is a perspective view illustrating a second inner rail and a second outer rail of the slide rail assembly according to the second illustrative embodiment.

A description is now given of a second illustrative embodiment of the present invention with reference to FIGS. 11A and 11B.

FIG. 11A is a perspective view illustrating the first inner rail 10A and the first outer rail 20A of the slide rail assembly 1 according to a second illustrative embodiment. FIG. 11B is a perspective view illustrating the second inner rail 10B and the second outer rail 20B of the slide rail assembly 1 according to the second illustrative embodiment. It is to be noted that, a description of those components explained above in the first illustrative embodiment is omitted, and the same reference numerals as those used in the first illustrative embodiment are also used in the second illustrative embodiment. In the slide rail assembly 1 according to the second illustrative embodiment, the first inner rail 10A of the inner rail unit 10 further includes a first stopper 17, the first outer rail 20A further includes a first stopper receiver 18 that contacts the first stopper 17 of the first inner rail 10A, the second inner rail 10B of the inner rail unit 10 further includes a second stopper 27, and the second outer rail 20B further includes a second stopper receiver 28 that contacts the second stopper 27 of the second inner rail 10B.

As illustrated in FIG. 11A, the first stopper 17 is provided between the first extending portion 13A and the first bulge 13B of the first substrate 13 in the longitudinal directions. A part of the first substrate 13 is cut in and bent toward the first outer rail 20A to form the first stopper 17. In other words, the first stopper 17 is provided between the first and third rollers 11 and 21 in the slide directions in the slide rail assembly 1.

The first stopper receiver 18 is provided between the third mounting hole 20*a*, to which the third roller 21 is rotatably mounted, and the third bulge 23A of the third substrate 23 in the longitudinal directions. A part of the third substrate 23 is cut in and bent toward the first inner rail 10A to form the first stopper receiver 18. In other words, in the slide rail assembly 1, the first stopper receiver 18 is provided downstream from the first stopper 17 in the accommodation direction of the sheet tray 202.

As illustrated in FIG. 11B, the second stopper 27 is provided between the second extending portion 15A and the second bulge 15B of the second substrate 15 in the longitudinal directions. A part of the second substrate 15 is cut in and bent toward the second outer rail 20B to form the second stopper 27. In other words, the second stopper 27 is provided between the second and fourth rollers 12 and 22 in the slide directions in the slide rail assembly 1.

The second stopper receiver 28 is provided between the fourth mounting hole 20*b*, to which the fourth roller 22 is rotatably mounted, and the fourth bulge 25A of the fourth substrate 25 in the longitudinal directions. A part of the fourth substrate 25 is cut in and bent toward the second inner rail 10B to form the second stopper receiver 28. In other words, in the slide rail assembly 1, the second stopper receiver 28 is provided downstream from the second stopper 27 in the withdrawal direction of the sheet tray 202.

Thus, in the second illustrative embodiment, a part of the first substrate 13 is cut in and bent toward the first outer rail 20A to form the first stopper 17, and a part of the third substrate 23 is cut in and bent toward the first inner rail 10A to form the first stopper receiver 18. As a result, slippage of the first outer rail 20A from the inner rail unit 10 is prevented without increasing the number of components. In addition, a part of the second substrate 15 is cut in and bent toward the second outer rail 20B to form the second stopper 27, and a part of the fourth substrate 25 is cut in and bent toward the second inner rail 10B to form the second stopper receiver 28. As a result, slippage of the second outer rail 20B from the inner rail unit 10 is prevented without increasing the number of components.

Figure 12:
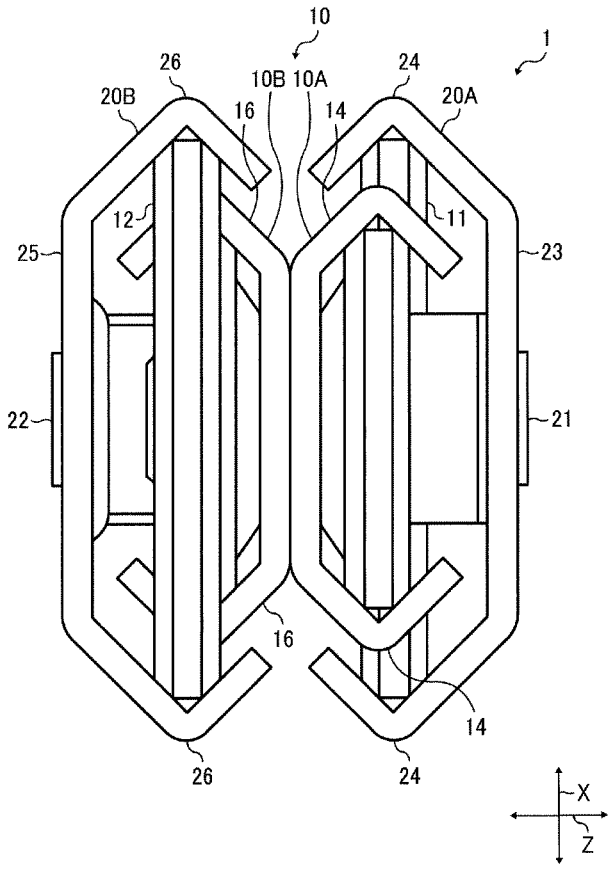
FIG. 12 is a vertical cross-sectional view illustrating an example of a configuration of a slide rail assembly according to a variation of illustrative embodiments.

It is to be noted that, although being L-shaped in cross-section in the foregoing illustrative embodiments, alternatively, the pairs of first, second, third, and fourth bent portions 14, 16, 24, and 26 may be either V-shaped in cross-section as shown in FIG. 12 or C-shaped in cross-section, respectively. The shapes of the pairs of first, second, third, and fourth bent portions 14, 16, 24, and 26 in cross-section are not limited to the above-described examples as long as the first, second, third, and fourth rollers 11, 12, 21, and 22 slidably engage therewithin, respectively.

Although the two separate first and second inner rails 10A and 10B are fixed together to be assembled into the inner rail unit 10 in the foregoing illustrative embodiments, alternatively, the first and second inner rails 10A and 10B may be formed together as a single integrated member by casting or the like.

In the foregoing illustrative embodiments, the first, second, third, and fourth rollers 11, 12, 21, and 22, are rotatably provided to the first and second inner rails 10A and 10B and the first and second outer rails 20A and 20B, respectively. However, the configuration is not limited thereto. Alternatively, the first, second, third, and fourth rollers 11, 12, 21, 22 may be provided unrotatably to the first and second inner rails 10A and 10B and the first and second outer rails 20A and 20B, respectively, or be not cylindrically shaped, as long as a portion in which each roller contacts the corresponding rail has a reduced frictional coefficient.

Although having the same shape and structure in the foregoing illustrative embodiments, the first and second inner rails 10A and 10B may have a different shape and structure and the first and second outer rails 20A and 20B may have a different shape and structure, as long as the first and second outer rails 20A and 20B are slidable against the inner rail unit 10, respectively. In addition, although having the same shape and structure, the first, second, third, and fourth rollers 11, 12, 21, and 22 may have different shapes and structures, respectively, as long as the first, second, third, and fourth rollers 11, 12, 21, and 22 are slidable against the respective bent portions 14, 16, 24, and 26.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. A slide rail assembly, comprising:

an inner rail unit comprising:

a rectangular inner substrate assembly;

a pair of first bent portions provided to a first side of the inner substrate assembly in thickness directions, one end of the pair of first bent portions being continuous with both edges of the inner substrate assembly in width directions, and opposite ends of the pair of first bent portions being bent toward each other; and a pair of second bent portions provided to a second side of the inner substrate assembly opposite the first side in the thickness directions, one end of the pair of second bent portions being continuous with both edges of the inner substrate assembly in the width directions, and opposite ends of the pair of second bent portions being bent toward each other;

a pair of first and second outer rails to sandwich the inner rail unit, the first outer rail comprising:

a rectangular first outer substrate; and a pair of third bent portions, one end of the pair of third bent portions being continuous with both edges of the first outer substrate in width directions, and opposite ends of the pair of third bent portions being bent toward each other, the second outer rail comprising:

a rectangular second outer substrate; and a pair of fourth bent portions, one end of the pair of fourth bent portions being continuous with both edges of the second outer substrate in the width directions, and opposite ends of the pair of fourth bent portions being bent toward each other, the pair of first and second outer rails being disposed with the pairs of third and fourth bent portions facing inward, and being slidable against the inner rail unit in both a withdrawal direction and an accommodation direction along longitudinal directions of the inner substrate assembly;

a first roller mounted to a leading end of the inner rail unit in the withdrawal direction to slidably contact inner surfaces of the pair of third bent portions;

a second roller mounted to a leading end of the inner rail unit in the accommodation direction to slidably contact inner surfaces of the pair of fourth bent portions;

a third roller mounted to a leading end of the first outer rail in the accommodation direction to slidably contact inner surfaces of the pair of first bent portions; and a fourth roller mounted to a leading end of the second outer rail in the withdrawal direction to slidably contact inner surfaces of the pair of second bent portions.

2. The slide rail assembly according to claim 1, wherein:

the inner substrate assembly is constructed of a first inner substrate and a second inner substrate laminated together;

the pair of first bent portions is provided to the first side of the inner substrate assembly in the thickness directions with the one end thereof continuous with both edges of the first inner substrate in width directions, and the opposite ends thereof bent toward each other; and the pair of second bent portions is provided to the second side of the inner substrate assembly in the thickness directions with the one end thereof continuous with both edges of the second inner substrate in width directions, and the opposite ends thereof bent toward each other.

3. The slide rail assembly according to claim 2, wherein the first roller and the second roller comprise:

a body having a hole at the center thereof; and a shaft inserted into the hole communicating with a through-hole penetrating both the first and second inner substrates to mount the roller to the inner rail unit.

4. The slide rail assembly according to claim 1, further comprising:

a first stopper formed by a part of the inner substrate assembly cut in and bent toward the first outer rail and disposed between the first and third rollers in slide directions of the pair of first and second outer rails against the inner rail unit; and a first stopper receiver to contact the first stopper, the first stopper receiver being formed by a part of the first outer rail cut in and bent toward the inner substrate assembly and disposed downstream from the first stopper in the accommodation direction.

5. The slide rail assembly according to claim 4, further comprising:

a second stopper formed by a part of the inner substrate assembly cut in and bent toward the second outer rail and disposed between the second and fourth rollers in the slide directions; and a second stopper receiver to contact the second stopper, the second stopper receiver being formed by a part of the second outer rail cut in and bent toward the inner substrate assembly and disposed downstream from the second stopper in the withdrawal direction.

6. A sheet feeder, comprising:

a sheet tray withdrawable from the sheet feeder to accommodate sheets; and a pair of slide rail assemblies mounted to both lateral sides of the sheet tray to guide the sheet tray in a withdrawal direction, each of the pair of slide rail assemblies comprising:

an inner rail unit comprising:

a rectangular inner substrate assembly;

a pair of first bent portions provided to a first side of the inner substrate assembly in thickness directions, one end of the pair of first bent portions being continuous with both edges of the inner substrate assembly in width directions, and opposite ends of the pair of first bent portions being bent toward each other; and a pair of second bent portions provided to a second side of the inner substrate assembly opposite the first side in the thickness directions, one end of the pair of second bent portions being continuous with both edges of the inner substrate assembly in the width directions, and opposite ends of the pair of second bent portions being bent toward each other;

a pair of first and second outer rails to sandwich the inner rail unit, the first outer rail comprising:

a rectangular first outer substrate; and a pair of third bent portions, one end of the pair of third bent portions being continuous with both edges of the first outer substrate in width directions, and opposite ends of the pair of third bent portions being bent toward each other, the second outer rail comprising:

a rectangular second outer substrate; and a pair of fourth bent portions, one end of the pair of fourth bent portions being continuous with both edges of the second outer substrate in the width directions, and opposite ends of the pair of fourth bent portions being bent toward each other, the pair of first and second outer rails being disposed with the pairs of third and fourth bent portions facing inward, and being slidable against the inner rail unit in both the withdrawal direction and an accommodation direction along longitudinal directions of the inner substrate assembly;

a first roller mounted to a leading end of the inner rail unit in the withdrawal direction to slidably contact inner surfaces of the pair of third bent portions;

a second roller mounted to a leading end of the inner rail unit in the accommodation direction to slidably contact inner surfaces of the pair of fourth bent portions;

a third roller mounted to a leading end of the first outer rail in the accommodation direction to slidably contact inner surfaces of the pair of first bent portions; and a fourth roller mounted to a leading end of the second outer rail in the withdrawal direction to slidably contact inner surfaces of the pair of second bent portions.

7. An image forming apparatus, comprising:

a sheet feeder comprising a sheet tray withdrawable from the sheet feeder to accommodate sheets; and a pair of slide rail assemblies mounted to both lateral sides of the sheet tray to guide the sheet tray in a withdrawal direction, each of the pair of slide rail assemblies comprising:

an inner rail unit comprising:

a rectangular inner substrate assembly;

a pair of first bent portions provided to a first side of the inner substrate assembly in thickness directions, one end of the pair of first bent portions being continuous with both edges of the inner substrate assembly in width directions, and opposite ends of the pair of first bent portions being bent toward each other; and a pair of second bent portions provided to a second side of the inner substrate assembly opposite the first side in the thickness directions, one end of the pair of second bent portions being continuous with both edges of the inner substrate assembly in the width directions, and opposite ends of the pair of second bent portions being bent toward each other;

a pair of first and second outer rails to sandwich the inner rail unit, the first outer rail comprising:

a rectangular first outer substrate; and a pair of third bent portions, one end of the pair of third bent portions being continuous with both edges of the first outer substrate in width directions, and opposite ends of the pair of third bent portions being bent toward each other, the second outer rail comprising:

a rectangular second outer substrate; and a pair of fourth bent portions, one end of the pair of fourth bent portions being continuous with both edges of the second outer substrate in the width directions, and opposite ends of the pair of fourth bent portions being bent toward each other, the pair of first and second outer rails being disposed with the pairs of third and fourth bent portions facing inward, and being slidable against the inner rail unit in both the withdrawal direction and an accommodation direction along longitudinal directions of the inner substrate assembly;

a first roller mounted to a leading end of the inner rail unit in the withdrawal direction to slidably contact inner surfaces of the pair of third bent portions;

a second roller mounted to a leading end of the inner rail unit in the accommodation direction to slidably contact inner surfaces of the pair of fourth bent portions;

a third roller mounted to a leading end of the first outer rail in the accommodation direction to slidably contact inner surfaces of the pair of first bent portions; and a fourth roller mounted to a leading end of the second outer rail in the withdrawal direction to slidably contact inner surfaces of the pair of second bent portions.

* * * * *